US005927296A

United States Patent [19]

Maturaporn

[11] Patent Number: 5,927,296

[45] Date of Patent: Jul. 27, 1999

[54] HAIR STYLING ACCESSORY WITH SEWINGLESS FABRIC COATING AND MANUFACTURING PROCESS THEREOF

[76] Inventor: Thawatchai Maturaporn, 228/68-69 Soi Siriwatana, Sathupradith Road, Bangklo, Bang Koleam, Bangkok 10120, Thailand

[21] Appl. No.: 08/944,614

[22] Filed: Oct. 6, 1997

[51] Int. Cl.[6] ..... A45D 8/20

[52] U.S. Cl. ..... 132/273

[58] Field of Search ..... 132/212, 273, 132/275; D28/39, 41

[56] References Cited

U.S. PATENT DOCUMENTS

| | | | |
|---|---|---|---|
| 3,211,160 | 10/1965 | Miller | 132/275 |
| 3,229,308 | 1/1966 | Jensen | D28/41 |
| 3,471,867 | 10/1969 | Kirchoff | 132/273 |
| 5,456,274 | 10/1995 | Selbee et al. | 132/275 |

OTHER PUBLICATIONS

KARINA, "Hair Ornament Colection", 1993 Spring/Summer Catalog, Oakland, NJ, pp. 6, 44, 47, 48.

*Primary Examiner*—Todd E. Manahan

*Attorney, Agent, or Firm*—David and Raymond; Raymond Y. Chan

[57] ABSTRACT

A hair styling accessory includes a C-shape band body having two band ends and a predetermined length and a sewingless tubular fabric coating. The tubular fabric coating has a ring-shape cross section and a length at least equal to the length of the band body, wherein the tubular fabric coating further has a cross section size at least equal to a cross section size of the band body. The band body is inserted inside the tubular coating. The tubular fabric coating has two ends first glued to two band end of band body, and two tips are welded and knitted by ultrasonic to define a close cavity therein to receive the band body, so that the tubular fabric coating being wrapped around the band body so as to entirely cover the band body. Accordingly, no sewing line will be formed on the tubular fabric coating, so that the entire inner side is able to contact with the user's hair that can increase the grabbing ability and comfortability for the user.

17 Claims, 8 Drawing Sheets

HAIR STYLING ACCESSORY WITH SEWINGLESS FABRIC COATING AND MANUFACTURING PROCESS THEREOF

FIELD OF THE PRESENT INVENTION

The present invention relates to a hair styling accessory, and more particularly to a hair styling accessory, such as a head band, which is constructed with a sewingless fabric coating so as to avoid the presence of the protruding and rude sewing line, wherein the sewing line of the conventional head band would prop against the user's head and cause uncomfortable experience. Moreover, the present invention also provides a manufacturing process of the hair styling accessory with sewingless fabric coating, which reduces the manufacturing steps and cost of the hair styling accessory.

BACKGROUND OF THE PRESENT INVENTION

Hair styling accessories, such as head band or scrunchy, are commonly used by most ladies and girls for hair styling purposes. The head band is an arc-shape band body worn on the forehead for pulling and holding the user's bang backwards. The scrunchy is for tightening the hair into a bundle so that the hair would not get in the way of normal human activity.

Ladies spend much money on purchasing various hair styling accessories. Especially young girls today, hair styling accessory such as head band or scrunchy not only has its functional purpose, but also is a fashion statement. That is the reason why almost all girls have at least 5 different design of hair bands or scrunchys waiting for them to wear, but yet still continue buying new style or latest design.

The conventional head band 10, as shown in FIG. 1A, has a common great shortcoming that it has a sewing line 11 provided thereon. However, what kinds of problems may such sewing line 11 create?

First, the conventional head band 10 comprises a fabric coating 12 entirely wrapping up a C-shape plastic made tubular band body 13. In order to produce the tubular fabric coating 12 to wrap up the band body 13, two longitudinal sides of a rectangular piece of fabric are sewing together to form the tubular fabric coating 12 which is inside out to hide the excessive leftover edges 111. Accordingly, the sewing line 11 is formed, which is protruded along an inner side 14 of the head band 10 due to the gathering of the leftover edges 111, as shown in FIG. 1A.

When the head band 10 is worn on a user's head, the presence of this protruding portion near the sewing line 11 of the head band 10 would substantially reduce the contact area of the inner side 14 of the head band 10 with the user's hair. The main purpose of the head band 10 is to hold the hair backwardly in position so that the user can do their work without the hair getting in the way. The head band 10 can hold the hair in place due to the following two principals: First, the friction between the hair and the surface contact area of the head band 10 can provide a grabbing ability. Second, the elastic nature of the head band 10 enables the head band 10 be clipping on to the user's head.

As mentioned above, the protruding sewing line 11 formed on the inner side of the conventional head band 10 may reduce the contact surface area with the hair, that mean the friction therebetween also decreased. In order to make sure the head band 10 can firmly hold on the user's head to serve its purpose, most manufacturers would increase the elastic modules of the head band 10 so as to compensate the reducing of contact area and the decreasing of friction between the hair and the inner side 14 of the head band 10. When the elastic modules of the head band 10 is increased, more pressure would be applied on the user's head that may make the user feel very uncomfortable.

Moreover, the manufacturing process of the conventional head band 10 is quite complicated. First, a rectangular piece fabric material must be cut to required dimension and size. Second, two longitudinal sides of the fabric material are sewed together to form a tubular form fabric coating 12. Third, one end of the tubular fabric coating 12 is further sewed up. Fourth, make the fabric coating 12 inside out to hide the leftover edges 111. Fifth, insert the arc-shape band body 13 into the fabric coating 12 until it is entirely wrapped up by the fabric coating 12. Sixth, sew up the other end of the fabric coating 12.

The manufacturing process as mentioned above is very troublesome because most of the steps rely on manual work, that is time consuming and may unreasonably increase the manufacturing cost of the conventional head band 10.

Most of the users still highly refuse the presence of the sewing line 11, as shown in FIG. 1B, therefore some manufacturers further try to cover up the sewing line 11 on the inner side 14 with an additional cover strip 16. The additional cover strip 16 is generally sewed along the inner side 14 of the head band 10 to cover the sewing line 11 before inserting the band body 13. However, this cover strip 16 may made the head band 10 even more uncomfortable to wear because the head band 10 becomes more thicker. Besides, the cost and the complication of the production of the head band 10 would also increase.

The sewing line 11 also brings another frequently happened dilemma that, sometime the users may use the head band 10 and a hair clipper at same time to hold their hair in place. An end of the hair clipper might catch in the sewing line 11. Once the sewing line 11 is broken, the sewing line 11 tends to fall apart and the head band 10 be comes useless.

Other method of keeping the fabric coating on the tubular band body including usage of glue between a contact area of the fabric coating and the tubular band body. But after the head band 10 is been use for a while or the temperature change can all cause the glue to lose its strength, thus result in failure of the head band 10.

SUMMARY OF THE PRESENT INVENTION

The main objective of the present invention is to provide a hair styling accessory such as a head band, of which no sewing line is provided thereon, so that the entire inner side is able to contact with the hair that can increase the grabbing ability and comfortability for the user.

Another objective of the present invention is to provide a hair styling accessory such as a head band which comprises a tubular fabric coating for wrapping up an arc-shape band body, in which the two ends of the fabric coating are first glue to the two ends of the band body, and two tips of the fabric coating are welded by ultrasonic welding to ensure rigid and smooth ending connection between the fabric coating and the band body.

Another objective of the present invention is to provide a hair styling accessory such as a head band which having a simplified configuration that enable the manufacturer to produce the head band by more simple process that can save both the production time and the production cost.

Another objective of the present invention is to provide a hair styling accessory such as a head band which improves the outlook of the head band by eliminating the sewing line on the inner side of the head band.

Another objective of the present invention is to provide a manufacturing process of hair styling accessory which is adapted for mass production with minimum processing steps.

Accordingly, the present invention provides a hair styling accessory which comprises a C-shape band body having two band ends and a predetermined length and a sewingless tubular fabric coating. The sewingless tubular fabric coating has a ring-shape cross section and a length at least equal to the length of the band body, wherein the tubular fabric coating further has a cross section size at least equal to a cross section size of the band body. The band body is inserted inside the tubular fabric coating. The tubular fabric coating has two ends first glue to the two ends of the band body, and two tips of the fabric coating is welded and knitted by ultrasonic to define a close cavity therein to receive the band body, so that the tubular fabric coating being wrapped around the band body so as to entirely cover the band body.

The present invention also provides a manufacturing process of the hair styling accessory, comprising the steps of knitting the jersey and rib tubular into a large roll of elongated fabric tube; cutting an elongated fabric tube into a tubular fabric coating having a predetermined length at least equal to a length of a C-shape band body; inserting the C-shape band body into the tubular fabric coating until the band body is entirely wrapped around by the tubular fabric coating; and first gluing two ends of the tubular fabric coating to the two ends of the band body, and welding two tips of the tubular fabric coating by ultrasonic welding.

DETAILED DESCRIPTION OF THE PREFERRED EMBODIMENT

Figure 2:
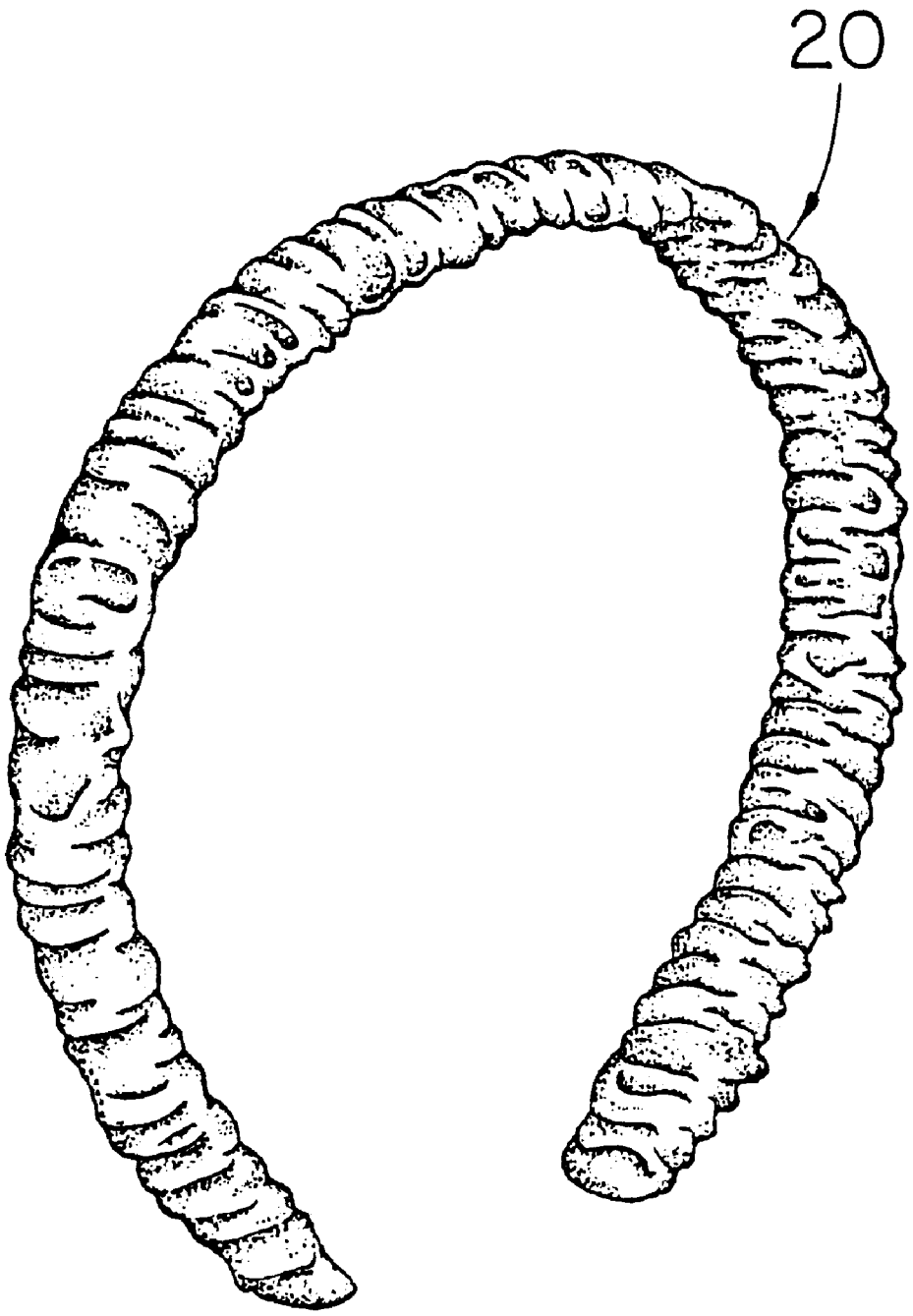
FIG. 2 is a perspective view of a hair styling accessory according to a first preferred embodiment of the present invention
Figure 3:
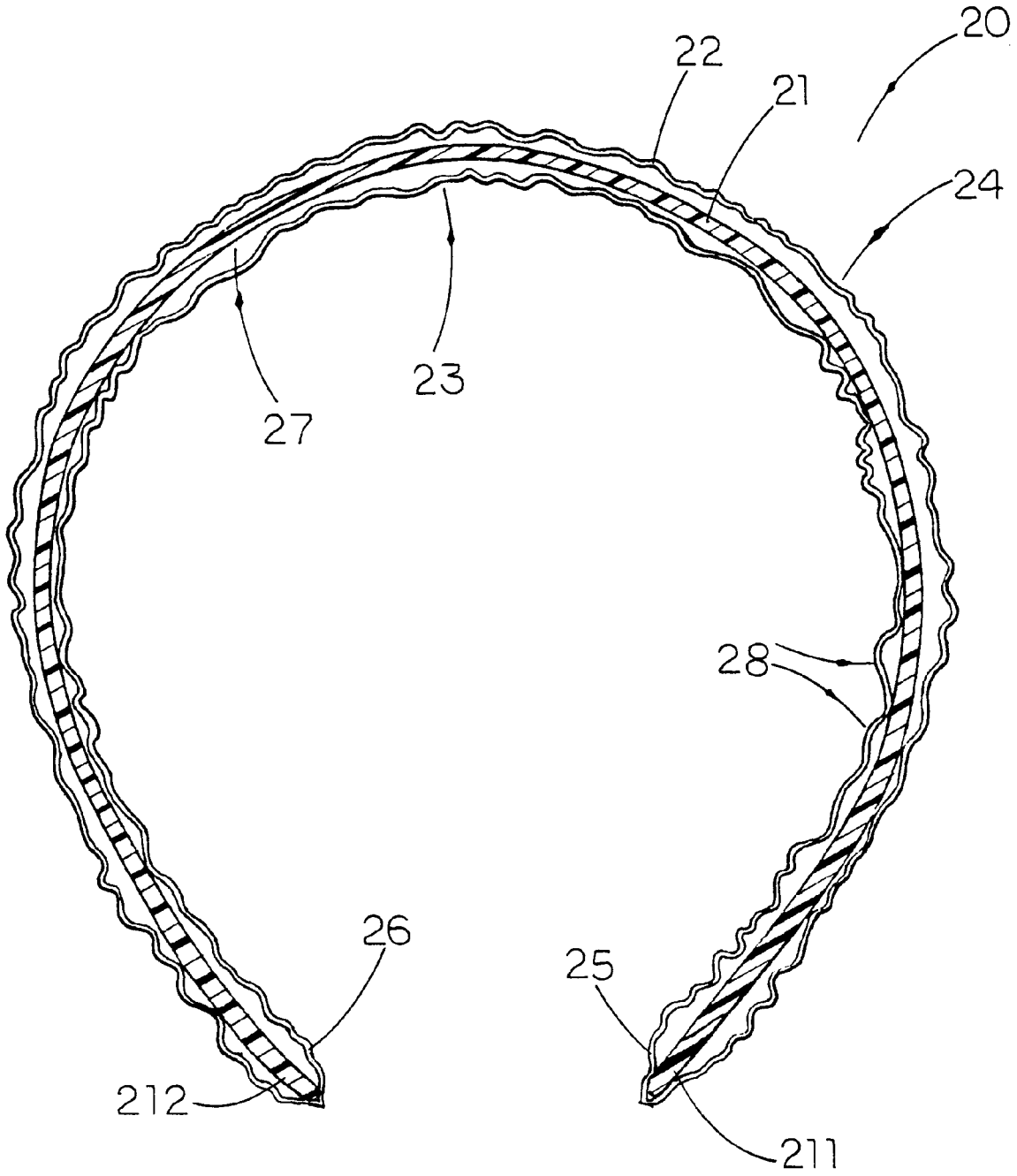
FIG. 3 is a sectional view of the hair styling accessory according to the above first preferred embodiment of the present invention.
Figure 4:
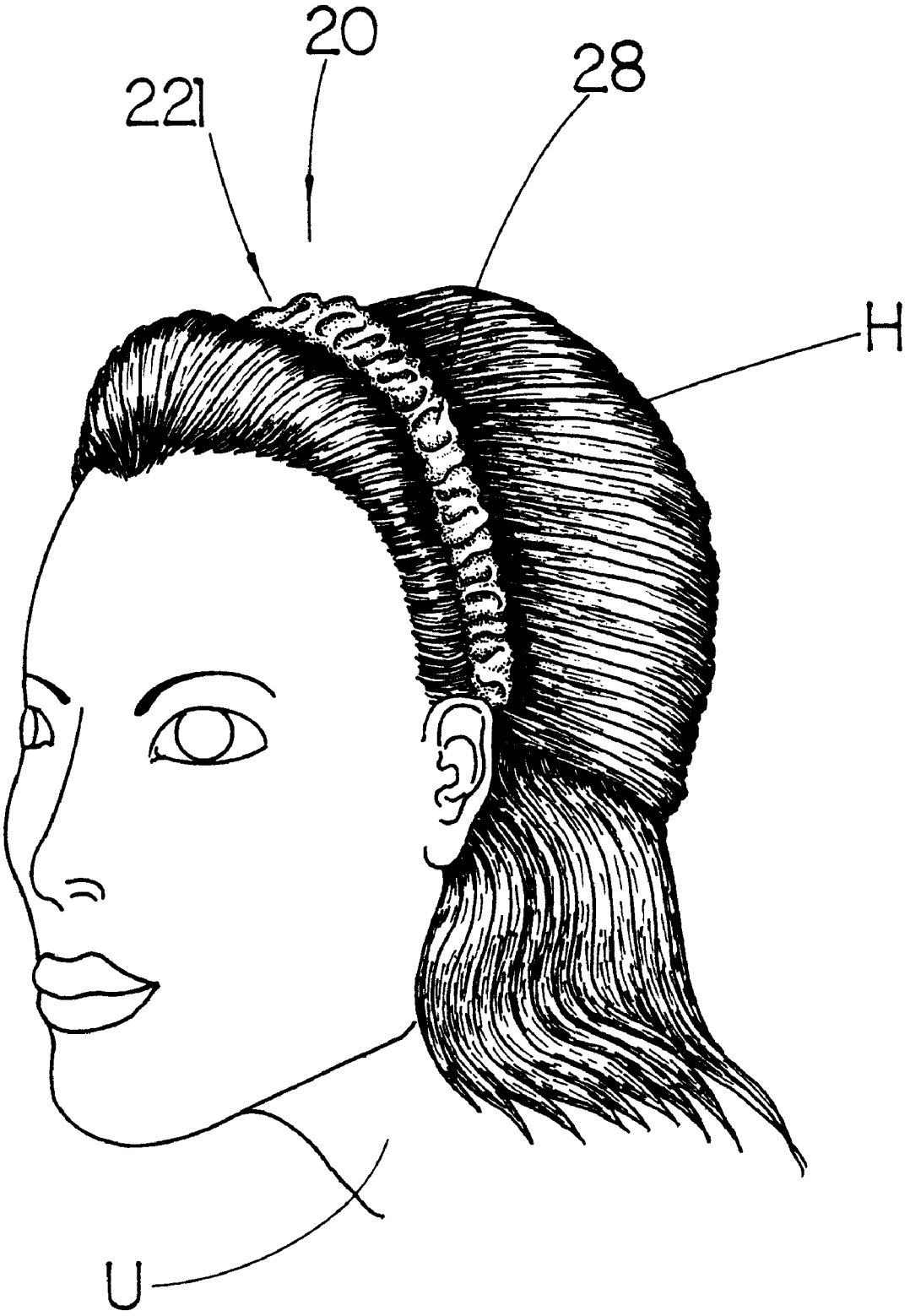
FIG. 4. is a perspective view of the hair styling accessory worn on an user's head according to the above first preferred embodiment of the present invention.

Referring to FIGS. 2 to 4 of the drawings, a hair styling accessory 20 comprises a holding element 21 and a sewingless tubular fabric coating 22 adapted for wrapping up the holding element 21. The tubular fabric coating 22 comprises a fabric tube without any sewing line which has a length at least equal to a length of the holding element 21, so that the holding element 21 is entirely covered by the fabric coating 22.

According to the first preferred embodiment of the present invention, as shown in FIGS. 2 to 4, a head band 20 is embodied as the hair styling accessory, wherein the holding element 21 is a plastic made C-shape band body 21 adapted for holding an user's bang backwards by firmly clipping on the user's head. The tubular fabric coating 22 is made of fabric material such as jersey and rib tubular which is an elongated tube having a ring-shape cross section.

As shown in FIG. 3, the C-shape band body 21 is disposed inside and along the tubular fabric coating 22. In other words, the tubular fabric coating 22 is wrapped around the C-shape band body 21 to form the head band 20 which has an inner surface 23, and an outer surface 24. The tubular fabric coating 22 has two ends 25, 26 which are first respectively glue to the two band ends 211, 212 of the C-shape band body 21, and then two tips 251, 261 of two ends 25, 26 of the tubular fabric coating 22 are welded together by ultrasonic by means of an ultrasonic machine (not shown in Figures), so that the two ends 25, 26 of the tubular fabric coating 22 are knitted to define a close cavity 27 therein to receive the C-shape band body 21, and that the two ends 25, 26 of the tubular fabric coating 22 are also firmly and integrally attached to the two band ends 211, 212 of the C-shape band body 21 so as to ensure good connecting relationship between the tubular fabric coating 22 and the C-shape band body 21 and to make sure that the tubular fabric coating 22 is enwrapped around the C-shape band body 21.

In accordance with the present first preferred embodiment, since the two tips of the tubular fabric coating 22 are welded by ultrasonic with the two band ends 211, 212 of the C-shape band body 21 respectively, the tubular fabric coating 22 can thus be made to have a cross section size larger than the cross section size of the C-shape band body 21. Moreover, the tubular fabric coating 22 is also made to have a length longer than the length of the C-shape band body 21, so that the entire surface of the tubular fabric coating 22, including the inner and outer surfaces 23, 24, is wrinkled to provide a plurality of wrinkles 28 around and along the tubular fabric coating 22.

As shown in FIG. 4, the wrinkles 28 of the tubular fabric coating 22 constitutes a wrinkle surface 221 which largely increases the contact area and the friction formed between the user's hair H and the head band 20. As the contact area increased, the ability for the head band 20 to stay on the user's head U also increase. Moreover, the wave form wrinkle surface 221 of the tubular fabric coating 22 provides additional features of holding the bang portion of the user's hair H in position and in wave style.

Figure 1A:
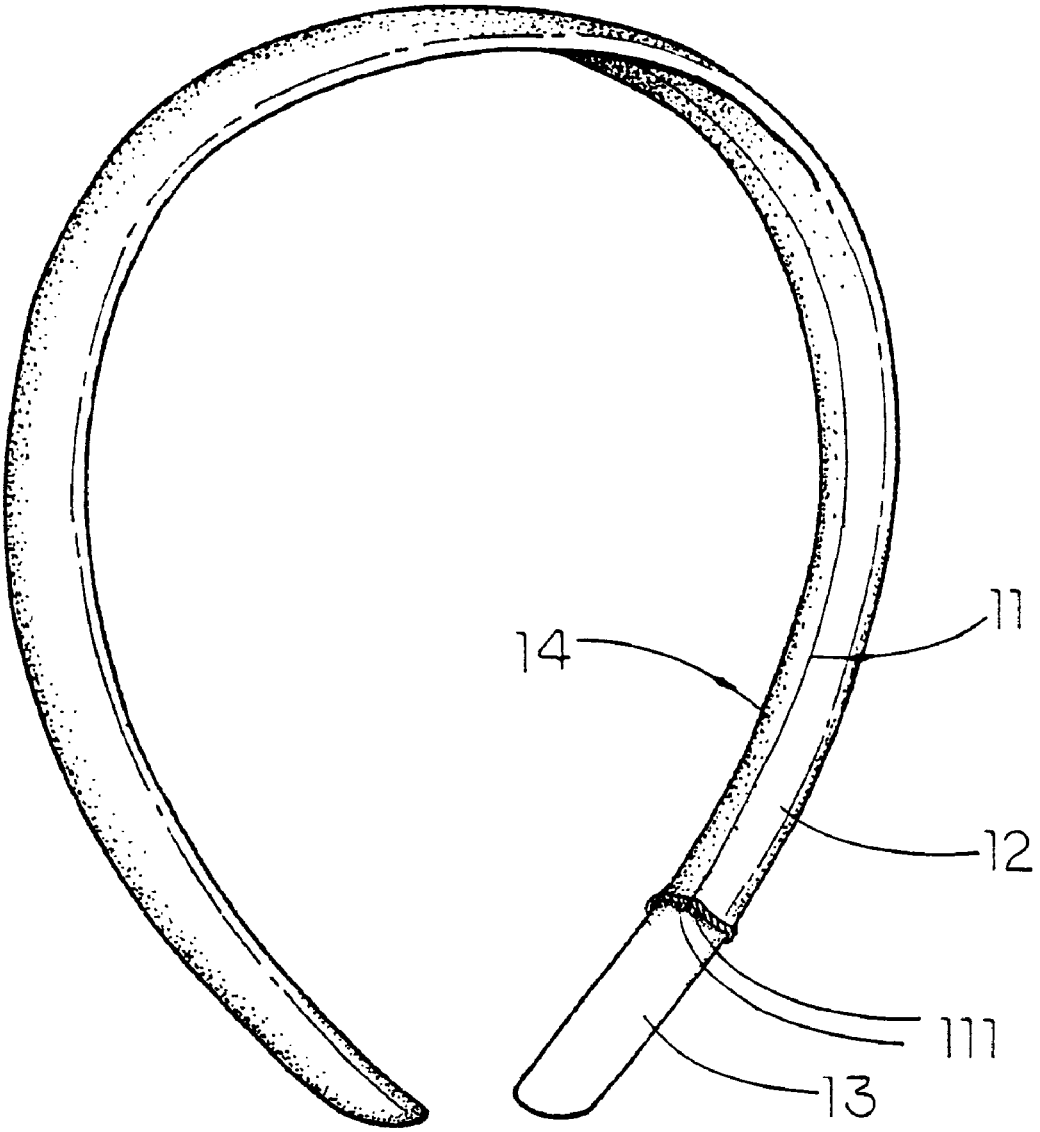
FIG. 1A PRIOR ART
FIG. 1A is a partially sectional perspective view of a conventional head band with the sewing line provided along an inner side thereof.
Figure 1B:
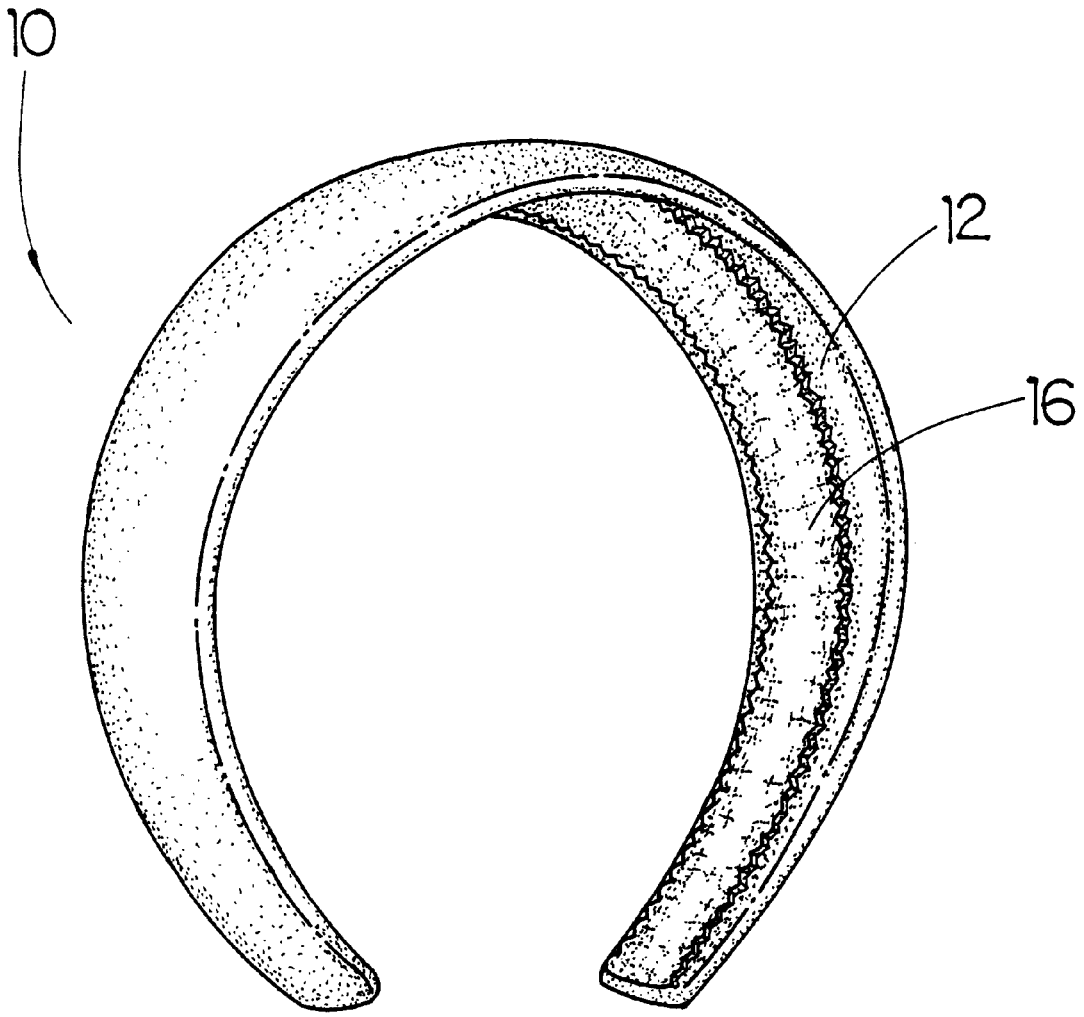
FIG. 1B PRIOR ART
FIG. 1B is a perspective view of the conventional head band with an additional cover strip sewed along the inner side of the head band to cover the sewing line or gluing line.

It is worth to mention that neither the inner surface 23 nor the outer surface 24 of the tubular fabric coating 22 has any sewing line formed thereon. The advantages of ultrasonic welding the two tips of the tubular fabric coating 22 with the two band ends 211, 212 of the C-shape band body 21 are that it enable the tubular fabric coating 22 to be integrally knitted in the tubular form and eliminates a lot of manufacturing process steps and cost. No more sewing step is required in the present invention. The sewing line 11 of the conventional head band 10, as shown in FIG. 1, can thus be eliminated along with all the problem described in the background of the invention.

Figure 5:
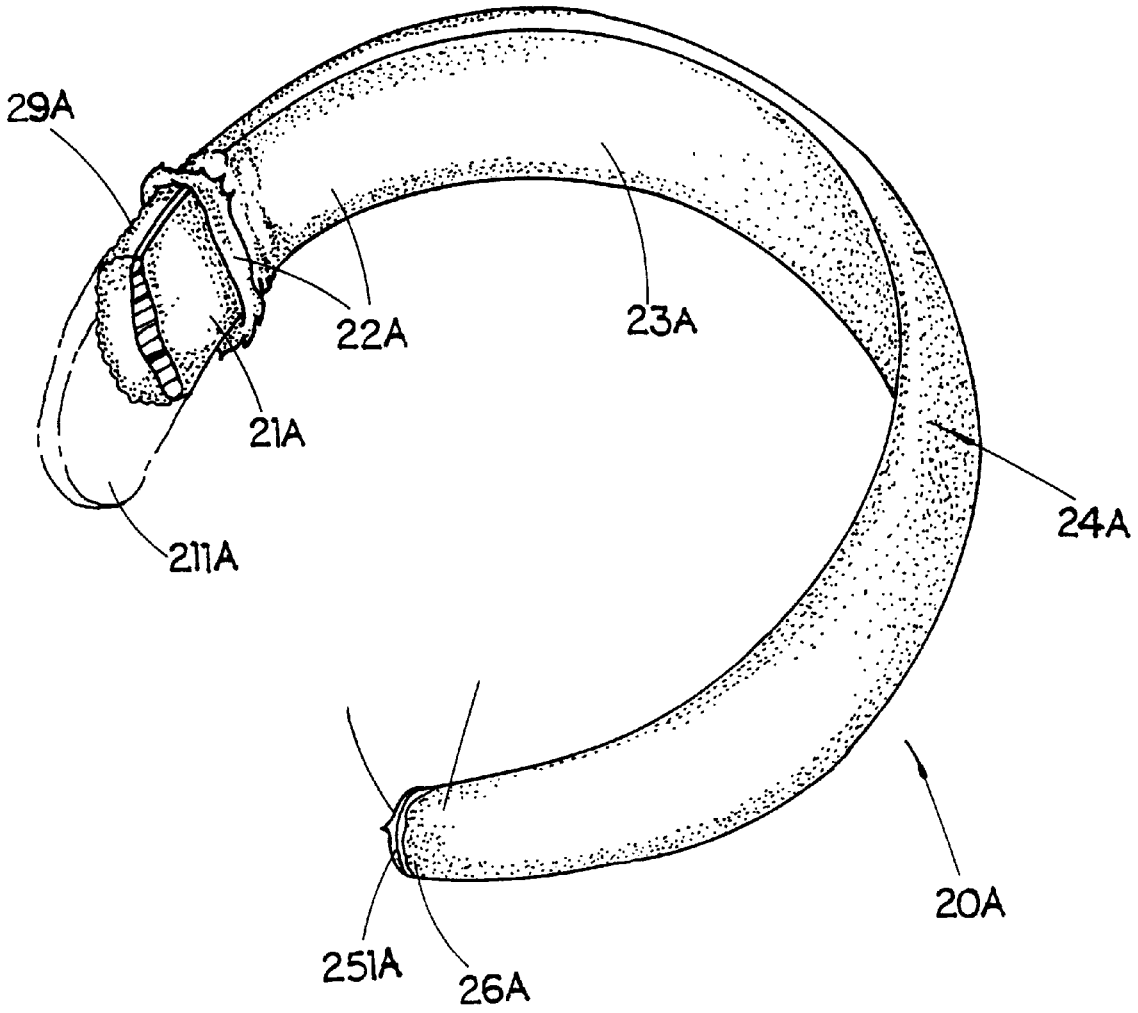
FIG. 5 is a partially sectional perspective view of a hair styling accessory according to a second preferred embodiment of the present invention.

Referring to FIG. 5 of the drawing, a second preferred embodiment of the present invention is illustrated, wherein the hair styling accessory of the present invention is embodied by flat-type head band 20A without wrinkle surface. The head band 20A also comprises a C-shape band body 21A and a tubular fabric coating 22A wrapping around the C-shape band body 21A, wherein the two ends 25A, 26A of the tubular fabric coating 22A are also first glued to the two band ends 211A, 212A and two tips 251A, 261 A of the two ends 25A, 26A of the tubular fabric coating 22A are welded together by ultrasonic by means of an ultrasonic machine (not shown in Figures) respectively. In order to provide a cushion effect, a cushion layer 29A made of foaming material may further be adhered to an outer surface (or an inner surface) of the C-shape band body 21A, and that the tubular fabric coating 22A is also made of a tubular jersey material according to the second preferred embodiment of the present invention, in which neither an inner surface 23A nor an outer surface 24A of the tubular fabric coating 22A has any sewing line formed thereon.

In accordance with the second preferred embodiment, the tubular fabric coating 22A has a size and length equal to or slightly greater than a size and length of the C-shape band body 21A, so that the tubular fabric coating 22A is flatly wrapped around the C-shape band body 21A and the cushion layer 29A to provide a smooth and flat contact surface.

Figure 6:
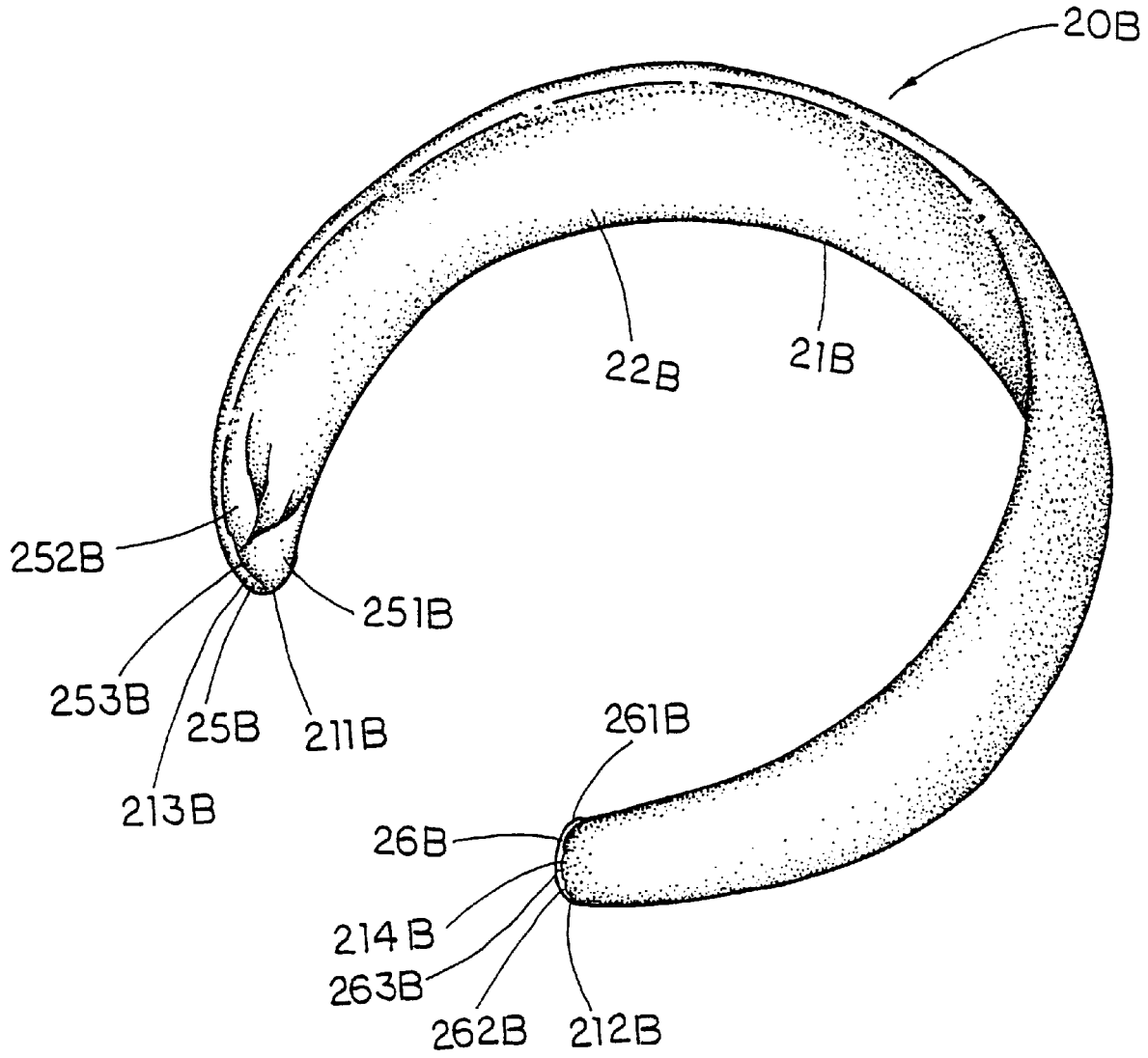
FIG. 6 is a perspective view of a hair styling accessory according to a third preferred embodiment of the present invention.

Referring to FIG. 6 of the drawing, a third preferred embodiment of the present invention is illustrated, wherein the hair styling accessory of the present invention is basically identical to the above second preferred embodiment except with an additional feature on the connection between the two end of the tubular fabric coating 22B and the two end of the C-shape band body 21B respectively. The head band 20B also comprises a C-shape band body 21B and a tubular fabric coating 22B wrapping around the C-shape band body 21B, wherein each of two ends 25B, 26B of the tubular fabric coating 22B has a right portion 251B, 261B and a left portion 252B, 262B. Each of the right portion 251B, 261B and the left portion 252B, 262B of the each ends 25B, 26B of the tubular fabric coating 22B is first folded to a center portion 253B, 263B of each end 25B, 26B. Two tips 213B, 214B of the tubular fabric coating 22B are then welded by ultrasonic with the two band ends 211B, 212B of the C-shape band body 21B respectively.

Figure 7:
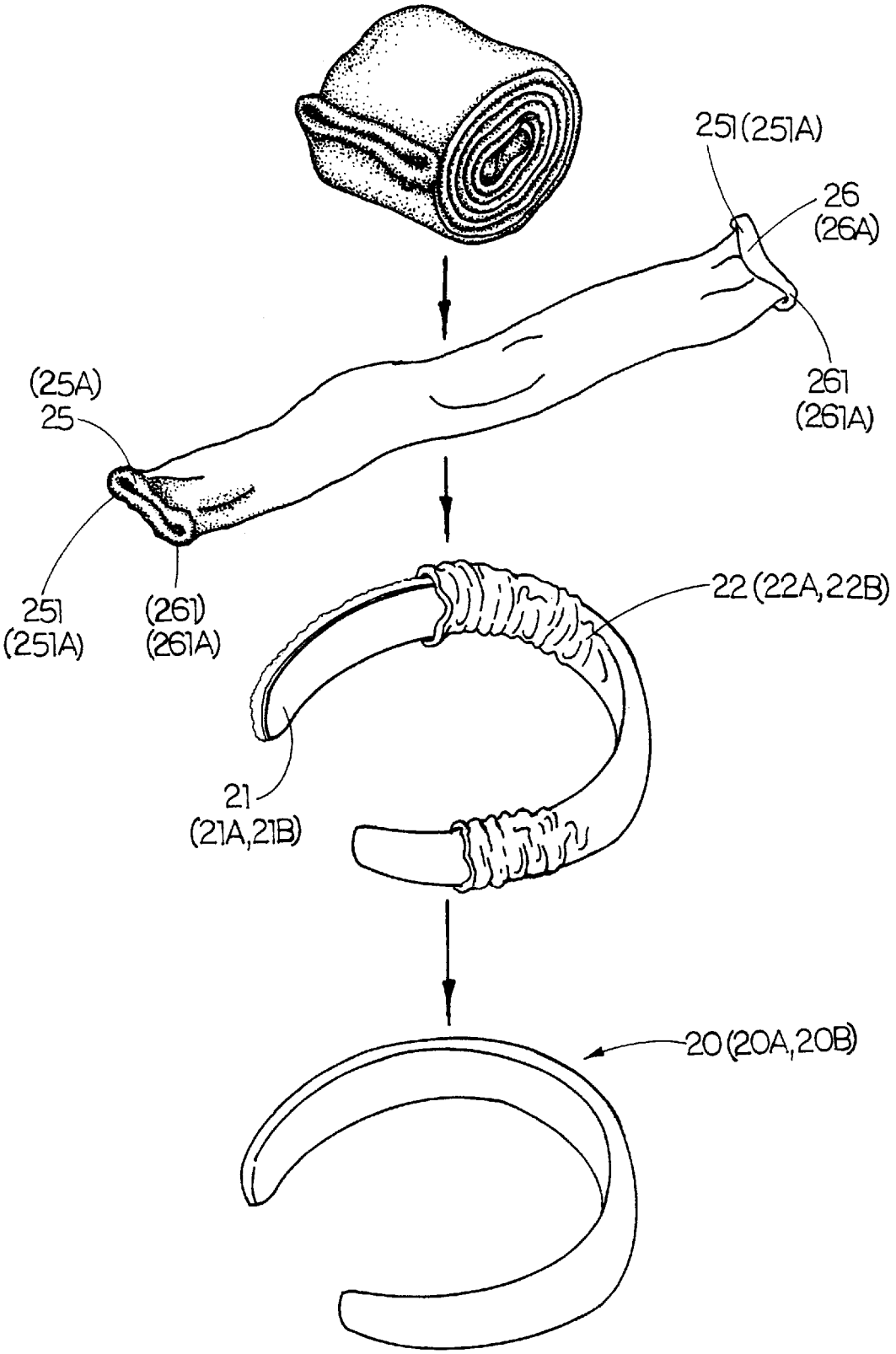
FIG. 7 is a manufacture process steps of the present invention according to the above first, second and third preferred embodiment.

As shown in FIG. 7, the manufacturing process of the head band 20, 20A, or 20B of the first, second, and third preferred embodiment according to the present invention is as simple as a four-step process as illustrated below:

1. Knitting the jersey and rib tubular into a large roll of elongated sewingless fabric tube.
2. Cutting the elongated sewingless fabric tube into a tubular fabric coating 22, 22A, 22B having a predetermined length at least equal to a length of a C-shape band body 21, 21A, 21B.
3. Inserting the C-shape band body 21, 21A, 21B into the tubular fabric coating 22, 22A, 22B until the C-shape band body 21, 21A, 21B is entirely wrapped around by the tubular fabric coating.
4. Gluing two ends of the tubular fabric coating 22, 22A, 22B with two band ends 211, 212, 211A, 212A, 211B, 212B of the C-shape band body 21, 21A, 21B.
5. Welding two tips 251, 261, 251A, 261A of two ends 25, 26, 25A, 26A of the tubular fabric coating 22, 22A, 22B respectively together by ultrasonic by means of an ultrasonic machine.

It is worth to mention that the two tips 212B, 213B of the two ends 25B, 26B of the tubular fabric coating 22B of the third preferred embodiment can be also welded to the band ends 211B, 212B of the C-shape band body 21B by ultrasonic by means of an ultrasonic machine.

One can notice that all the five steps of the manufacturing process described above can be processed by machinery adapted for mass production, wherein the production time and cost of the head band 20, 20A, or 20B can thus be largely reduced. No time and labor consuming needs to involved.

I claim:

1. A hair styling accessory, comprising:

a C-shape band body having two band ends and a predetermined length; and a sewingless tubular fabric coating having a ring-shape cross section and a length longer than said length of said C-shape band body, wherein said tubular fabric coating further has a cross section size at least equal to a cross size of said C-shape band body, said C-shape band body being inserted inside said tubular fabric coating, said tubular fabric coating having two ends first glued to two ends of said C-shape band body, two tips of said tubular fabric coating being respectively welded with said two band ends of said C-shape band body by ultrasonic to define a closed cavity therein to receive said C-shape band body, said tubular fabric coating being wrapped around said C-shape band body so as to entirely cover said C-shape band body, wherein an entire surface of said tubular fabric coating is wrinkled to form a wrinkle surface having a plurality of wrinkles provided around and along said tubular fabric coating.

2. A hair styling accessory, as recited in claim 1, wherein said cross section size of said tubular fabric coating is larger than said cross section size of said C-shape band body.

3. A hair styling accessory, as recited in claim 2, further comprising a cushion layer adhering to one side of said C-shape band body, wherein said tubular fabric coating is enwrapping around both said C-shape band body and said cushion layer.

4. A hair styling accessory, as recited in claim 3, wherein said cushion layer is adhered to an outer layer of said C-shape band body.

5. A hair styling accessory, as recited in claim 4, wherein said cushion layer is made of foam material.

6. A hair styling accessory, as recited in claim 3, wherein said cushion layer is made of foam material.

7. A hair styling accessory, as recited in claim 1, further comprising a cushion layer adhering to one side of said C-shape band body, wherein said tubular fabric coating is enwrapping around both said C-shape band body and said cushion layer.

8. A hair styling accessory, as recited in claim 7, wherein said cushion layer is adhered to an outer layer of said C-shape band body.

9. A hair styling accessory, as recited in claim 8, wherein said cushion layer is made of foam material.

10. A hair styling accessory, as recited in claim 7, wherein said cushion layer is made of foam material.

11. A hair styling accessory, comprising:

a C-shape band body having two band ends and a predetermined length; and a sewingless tubular fabric coating having a ring-shape cross section and a length at least equal to said length of said C-shaped band body, wherein said tubular fabric coating further has a cross section size at least equal to a cross size of said C-shape band body, said C-shape band body being inserted inside said tubular fabric coating, said tubular fabric coating being wrapped around said C-shape band body so as to entirely cover said C-shape band body, wherein said tubular fabric coating having two ends first glued to two ends of said C-shaped band body, each of said two ends of said tubular fabric coating has a right portion and a left portion, each of said right and left portions of each of said ends of said tubular fabric coating is first folded to a center portion of each said end, and two tips of said tubular fabric coating are then welded by ultrasonic with said two band ends of said C-shape band body respectively.

12. A hair styling accessory, as recited in claim 11, further comprising a cushion layer adhering to one side of said C-shape band body, wherein said tubular fabric coating is enwrapping around both said C-shape band body and said cushion layer.

13. A hair styling accessory, as recited in claim 12, wherein said cushion layer is adhered to an outer layer of said C-shape band body.

14. A hair styling accessory, as recited in claim 13, wherein said cushion layer is made of foam material.

15. A hair styling accessory, as recited in claim 12, wherein said cushion layer is made of foam material.

16. A manufacturing process of a hair styling accessory, comprising the steps of:

(a) knitting a jersey and rib tubular fabric into a large roll of elongated sewingless fabric tube;

(b) cutting and elongated sewingless fabric tube into a tubular fabric coating having a predetermined length at least equal to a length of a C-shape band body;

(c) inserting said C-shape band body into said tubular fabric coating until said C-shape band body is entirely wrapped around by said tubular fabric coating;

(d) gluing two ends of said tubular fabric coating with two band ends of said C-shape band body; and (e) welding two tips of said two ends of said tubular fabric coating together by ultransonic, wherein said two tips of said two ends of said tubular fabric coating are welded by ultrasonic to said two band ends of said C-shape band body.

17. A manufacturing process of a hair styling accessory, as recited in claim 16, wherein before step (b), further comprising a step of adhering a cushion layer to one side of said C-shape band body.

* * * * *